US006652246B1

(12) United States Patent
Lin et al.

(10) Patent No.: US 6,652,246 B1
(45) Date of Patent: Nov. 25, 2003

(54) CENTRIFUGAL FAN HAVING UPSIDE-DOWN MOUNTED STRUCTURE

(75) Inventors: Kuo-cheng Lin, Taoyan Hsien (TW); Ming-shi Tsai, Taoyan Hsien (TW); Yu-huang Huang, Taoyan Hsien (TW); Wen-shi Huang, Taoyan Hsien (TW)

(73) Assignee: Delta Electronics, Inc. (TW)

( * ) Notice: Subject to any disclaimer, the term of this patent is extended or adjusted under 35 U.S.C. 154(b) by 10 days.

(21) Appl. No.: 09/672,112

(22) Filed: Sep. 27, 2000

(30) Foreign Application Priority Data

Apr. 24, 2000 (TW) ..... 89206741 U

(51) Int. Cl.[7] ..... F04B 17/00
(52) U.S. Cl. ..... 417/360
(58) Field of Search ..... 417/360, 321; 415/119, 203, 204, 205, 206; 361/695, 687, 681

(56) References Cited

U.S. PATENT DOCUMENTS 2,331,958 A * 10/1943 Breese et al. ..... 34/222
3,425,621 A * 2/1969 Greenheck ..... 230/235
3,871,795 A * 3/1975 Habdo et al. ..... 417/360
4,092,088 A * 5/1978 Nemesi ..... 417/360
4,130,376 A * 12/1978 Dietsche
4,775,294 A * 10/1988 LaPorte ..... 415/201
4,824,333 A * 4/1989 Erickson, Jr. ..... 417/360
4,880,364 A * 11/1989 Berfield et al. ..... 417/423.1
5,052,888 A * 10/1991 Bolton et al. ..... 415/182.1
5,492,456 A * 2/1996 Knight et al. ..... 417/360
5,566,377 A * 10/1996 Lee ..... 361/695
5,936,836 A * 8/1999 Scholder ..... 361/695
6,141,218 A * 10/2000 Miyahara ..... 361/695
6,205,027 B1 * 3/2001 Nakajima ..... 361/719
6,243,261 B1 * 6/2001 Janik et al. ..... 361/687
6,317,319 B1 * 11/2001 Lewis et al. ..... 361/695

* cited by examiner

*Primary Examiner*—Daniel Robinson
(74) *Attorney, Agent, or Firm*—Martine & Penilla, LLP

(57) ABSTRACT

A centrifugal fan having an upside-down mounted structure and being mounted on a heat-dissipating plate includes a frame fixed on the heat-dissipating plate and a stator upside-down mounted in the frame and fixed on the upper surface. The frame includes an upper surface positioned away from the heat-dissipating plate, a side surface substantially perpendicular to the upper surface, at least one inlet formed on the upper surface, and an outlet formed on the side surface. The stator includes a printed circuit board positioned close to the upper surface and positioned away from the heat-dissipating plate.

8 Claims, 4 Drawing Sheets

CENTRIFUGAL FAN HAVING UPSIDE-DOWN MOUNTED STRUCTURE

BACKGROUND OF THE INVENTION

1. Field of the Invention

The invention relates to a centrifugal fan having an upside-down mounted structure, and more particularly to a centrifugal fan having an upside-down mounted structure so as to possess a relatively long service life.

2. Description of the Related Art

Recently, electrical products tend to be smaller and thinner than ever. Notebook computers as described below for example, are getting thinner and thinner. A heat-dissipating device for a notebook computer includes a fan and a heat-dissipating plate for dissipating the heat energy generated during the computer operation. Therefore, the development of a relatively thin heat-dissipating device is in demand for a relatively thin notebook computer.

FIG. 4A is a top view of a conventional heat-dissipating device, and FIG. 4B is a front view of FIG. 4A. Referring to FIG. 4A, the heat-dissipating device includes an axial-flow fan 100 and a heat-dissipating plate 200. The axial-flow fan 100 includes a motor (not shown), a frame 101, and an axial-flow type of impeller 104. The motor used for driving purpose has a printed circuit board (not shown) positioned at its bottom, and the frame has four ribs 102 and an outlet 103 while the axial-flow impeller 104 has a hub 105 and a plurality of blades 106. In addition, a plurality of fins 201 and passages 202 are formed on the heat-dissipating plate 200 for dissipating heat.

Because the heat-dissipating device must be made relatively thin, the prior art in which the axial-flow fan 100 is directly mounted above the fins 201 cannot be adopted in a notebook computer or other similar electric products due to the limited thickness.

Referring to FIG. 4B, the heat-dissipating plate 200 is in L-shape and the axial-flow fan 100 is mounted on the right side surface of the heat-dissipating plate 200. When the axial-flow fan 100 rotates, the air is sucked in on one side and blown out on the other side, and the arrowheads indicate the direction of airflow. That is, the air flows from the topside of the axial-flow fan 100 into the axial-flow fan 100, and then, it flows from the frame 101 to the passages 202 of the heat-dissipating plate 200 to achieve the function of heat-dissipation.

The axial-flow fan of the prior art cannot provide relatively high air pressure either. The heat dissipating effect is relatively poor due to the interference of the plurality of fins 201. In addition, it is also due to the fact that the printed circuit board at the bottom of the motor is positioned close to the heat-dissipating plate 200 or even in direct contact with the heat-dissipating plate 200. In general, the temperature of the heat-dissipating plate 200 is much higher than that of the fan in operation. In this case, the relatively high temperature of the heat-dissipating plate 200 will shorten the service life of the fan.

FIG. 5A is a top view of a conventional heat-dissipating device, and FIG. 5B is a front view of FIG. 5A. Referring now to FIG. 5A, the heat-dissipating device includes an axial-flow fan without frames, and a heat-dissipating plate 400. The axial-flow fan includes a motor (not shown), a base 301, and an axial-flow impeller 304. The motor has a printed circuit board (not shown) at its bottom while the axial-flow impeller 304 has a hub 305 and a plurality of blades 306. The heat-dissipating plate 400 includes a plurality of fins 401, a fan seat 403, and an outlet 404. The plurality of fins 401 are used for dissipating heat, and the fan seat 403 is for receiving the axial-flow fan and providing flow ducts of the frameless type. And the outlet 404 is formed on the side surface of the fan seat 403 for the air to flow into the passage 402.

Referring to FIG. 5B, the axial-flow fan 300 is mounted inside the fan seat 403 of the heat-dissipating plate 400. The axial-flow fan 300 sucks the air into the fan seat 403 and discharges the air therefrom. The arrowheads indicate the direction of the airflow. That is, the air flows into the axial fan from the topside thereof, it then flows through the passage 402 of the heat-dissipating plate 400 and the outlet 404 to achieve the function of heat-dissipating.

The axial-flow fan of the above-mentioned prior art cannot provide a relatively high air pressure either. This is because that under the blocking effect of the plurality of fins 401, a relatively good radiation effect cannot be obtained.

In addition, the printed circuit board located under the motor is positioned close to or in direct contact with the heat-dissipating plate 400. In general, the temperature of the heat-dissipating plate 400 is higher than the temperature of the fan in operation. Therefore, the high temperature of the heat-dissipating plate 400 may shorten the service life of the fan. Furthermore, the heat-dissipating plate 400 of axial-flow fan applicable for using the frame-less type can not control the airflow produced by the axial-flow fan without the fan seat 403. The fan seat 403, the fins 401, and the passages 402 are integrally formed, and all of them are generally made of aluminum material. In case that the fan seat 403 is integrally formed with the axial-flow fan300, it is preferable that both the fan seat 403 and the axial-flow fan300 are made of plastic material that has a lower density than that of the aluminum material. Therefore, in comparison with the heat-dissipating device as shown in FIG. 4A, the weight of the heat-dissipating device as shown in FIG. 5A is increased further.

SUMMARY OF THE INVENTION

It is therefore one of the object of the invention to provide a centrifugal fan having an upside-down mounted structure capable of preventing the electric elements of the fan from being affected by the heat-dissipating plate with relatively high temperature in order to increase its service life. In addition, the centrifugal fan can also provide a better radiation effect than that of the conventional axial-flow fan.

In accordance with one embodiment of the invention, a centrifugal fan having an upside-down mounted structure is mounted on a heat-dissipating plate. The centrifugal fan includes a frame fixed on the heat dissipating plate and a stator upside-down mounted in the frame and fixed on the upper surface. The frame includes an upper surface positioned away from the heat-dissipating plate, a side surface substantially perpendicular to the upper surface, at least one inlet formed on the upper surface, and an outlet formed on the side surface. The stator includes a printed circuit board positioned close to the upper surface and positioned away from the heat-dissipating plate.

The frame may further includes a bearing seat connected to the upper surface of the frame and at least one rib formed on the upper surface of the frame for fixing the bearing seat. The at least one inlet is defined by the upper surface of the frame and the at least one rib.

It is preferable that the centrifugal fan having an upside-down mounted structure further includes a centrifugal impeller enclosing the stator and capable of rotating with respect to the stator. The centrifugal impeller includes a hub and a plurality of blades connected to the hub to form a plurality of connection portions positioned close to the heat-dissipating plate and positioned away from the upper surface of the frame.

DETAIL DESCRIPTION OF THE INVENTION

A preferred embodiment of the invention will be described in detail with reference to the drawings.

Figure 1:
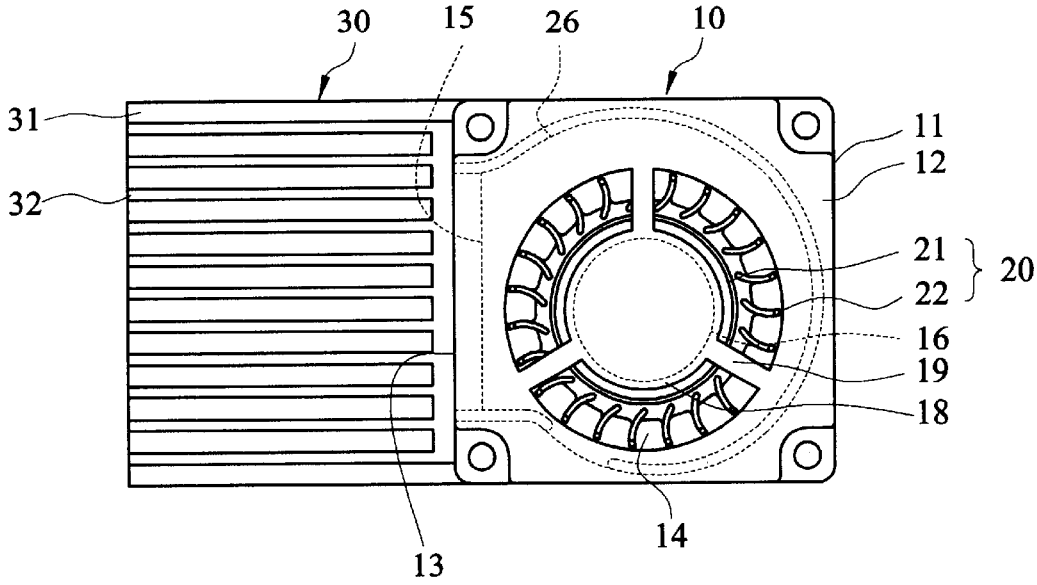
FIG. 1 is a schematic top view of the disposition of a centrifugal fan having an upside-down mounted structure and heat-dissipating plate in accordance with a preferred embodiment of the invention.
Figure 2:
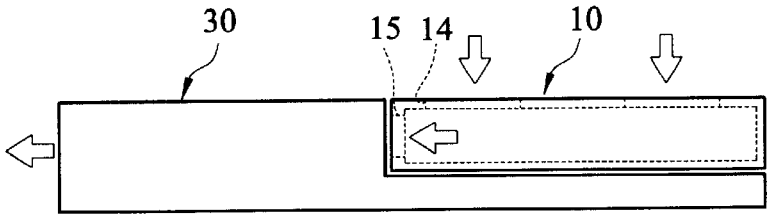
FIG. 2 is a front view of the heat-dissipating device as shown in FIG. 1.

FIG. 1 is a schematic top view of a heat-dissipating device in accordance with a preferred embodiment of the invention, and FIG. 2 is a front view of the heat-dissipating device as shown in FIG. 1. Referring now to FIGS. 1 and 2, the heat-dissipating device includes a centrifugal fan 10 and a heat-dissipating plate 30. The centrifugal fan 10 having an upside-down mounted structure includes a frame 11 fixed on the heat-dissipating plate 30, a stator 16, and a centrifugal impeller 20. The frame 11 includes an upper surface 12, a side surface 13, three inlets 14, an outlet 15, a bearing seat 18, and three ribs 19. The centrifugal impeller 20 includes a hub 21 and a plurality of blades 22. The heat-dissipating plate 30 includes a plurality of fins 31 for dissipating heat, and a plurality of passages 32.

A flow duct 26 is formed inside the frame 11 for collecting the airflow to increase the air pressure produced by the centrifugal fan 10. The centrifugal fan 10 is mounted on the heat-dissipating plate 30 and the side surface 13 is substantially vertical to the upper surface 12. The inlets 14 are formed on the upper surface 12 while the outlet 15 is formed on the side surface 13. Three inlets 14 are defined by the upper surface 12 of the frame 11 and the three ribs 19. The ribs 19 support the bearing seat 18 for fixing the stator 16.

When the centrifugal fan 10 is operated, the air is flowing in the direction indicated by the arrowheads as shown in FIG. 2 for dissipating heat. Specifically, the air flows into the centrifugal fan 10 through the three inlets 14, and then, flows into the passages 32 of the heat-dissipating plate 30 through the outlet 15 for dissipating the heat energy from the heat-dissipating plate 30.

Figure 3:
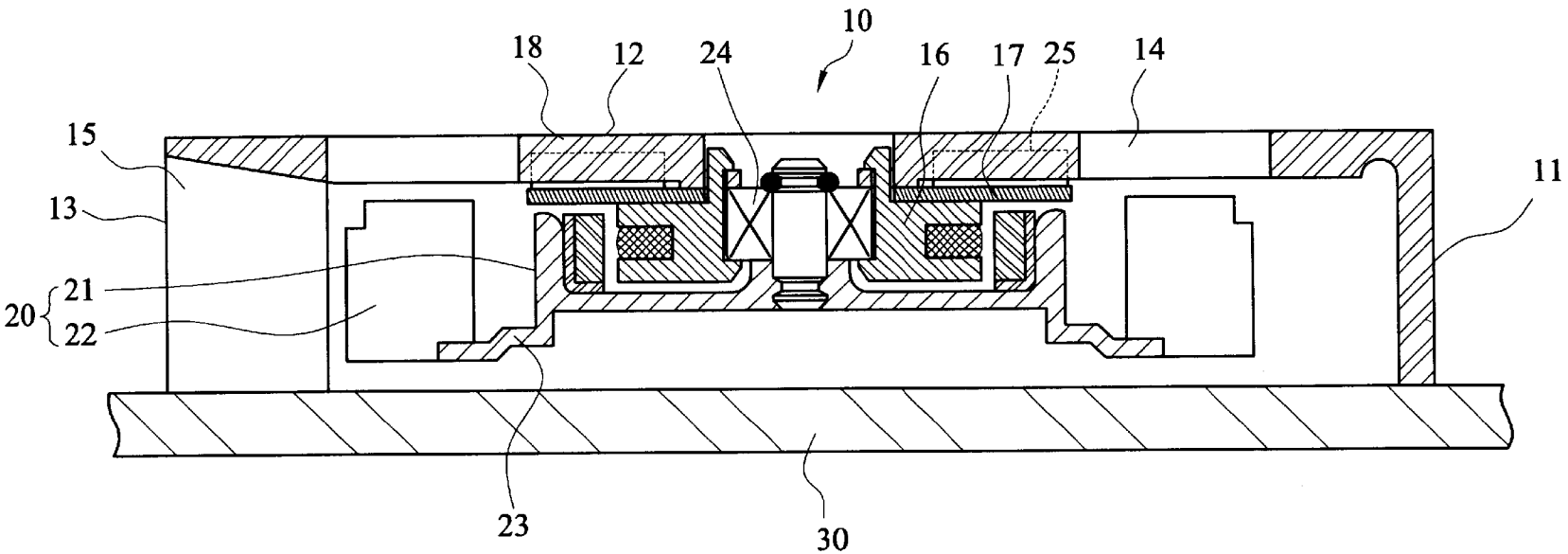
FIG. 3 is a cross-section view of the centrifugal fan having an upside-down mounted structure as shown in FIG. 1.
Figure 4A:
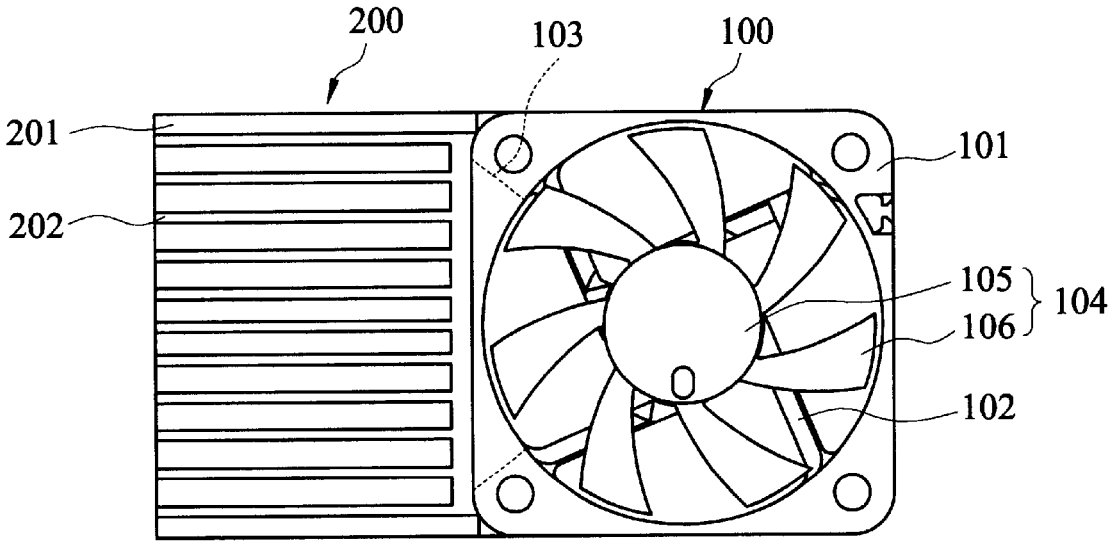
FIG. 4A (PRIOR ART)
FIG. 4A is a top view of a conventional heat-dissipating device.
Figure 4B:
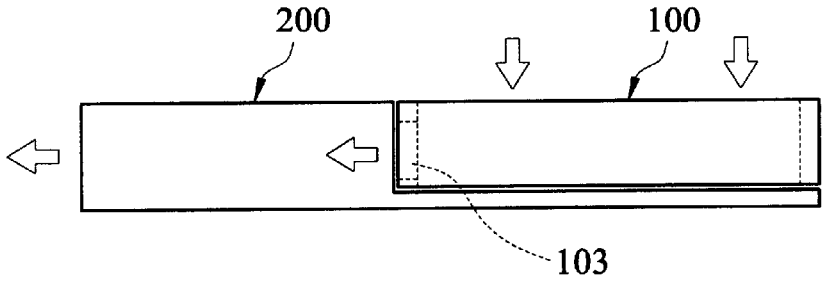
FIG. 4B (PRIOR ART)
FIG. 4B is a front view of FIG. 4A.
Figure 5A:
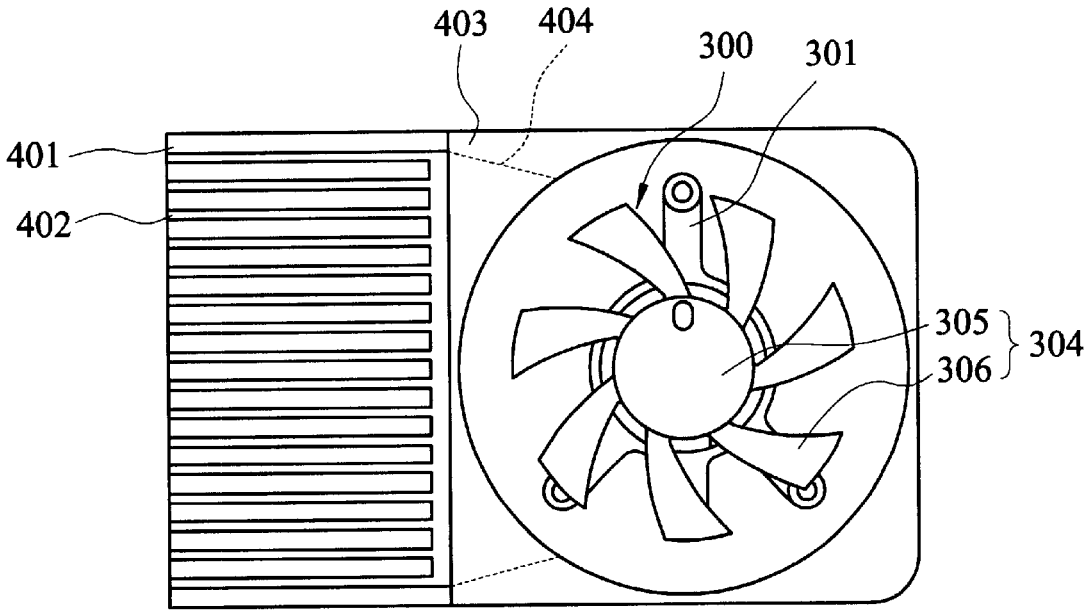
FIG. 5A (PRIOR ART)
FIG. 5A is a top view of another conventional heat-dissipating device.
Figure 5B:
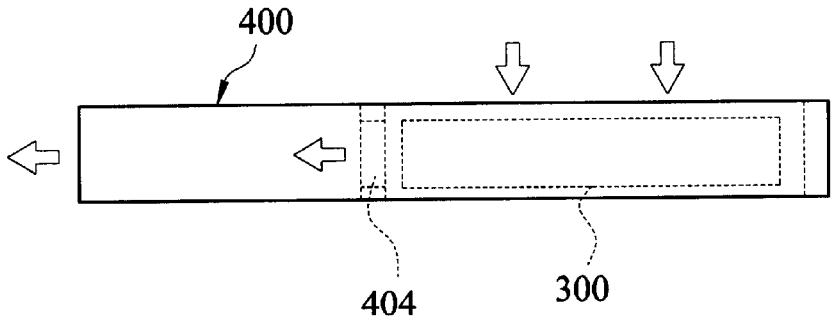
FIG. 5B (PRIOR ART)
FIG. 5B is a front view of FIG. 5A.

The characteristic of the invention will be better understood with reference to a cross-sectional view as shown in FIG. 3.

FIG. 3 is a cross-sectional view of the centrifugal fan having an upside-down mounted structure as shown in FIG. 1. Referring to FIG. 3, the centrifugal fan 10 having an upside-down mounted structure in accordance with the invention is mounted on a heat-dissipating plate 30. The centrifugal fan 10 includes a frame 11, a stator 16, a bearing seat 18, a centrifugal impeller 20, and a bearing 24. The frame 11 includes an upper surface 12, a side surface 13, three inlets 14, and an outlet 15. The upper surface 12 is positioned away from the heat-dissipating plate 30. The side surface 13 is substantially vertical to the upper surface 12. The three inlets 14 are formed on the upper surface 12 while the outlet 15 is formed on the side surface 13. The stator 16 includes a printed circuit board 17 and a plurality of electric elements 25.

The bearing seat 18 is located on the upper surface 12 of the frame 11 and is supported by the ribs 19 (as shown in FIG. 1). The centrifugal impeller 20 includes a hub 21 and a plurality of blades 22. A plurality of connection portions 23 are formed at connection portions between the hub 21 and each of the blades 22.

The bearing 24 is mounted in the bearing seat 18 and the stator 16 is upside-down mounted on the upper surface 12 of the frame 11 while the electric elements 25 are mounted on the printed circuit board 17. In general, the electric elements 25 are easily to be damaged at high temperature.

Comparing with the prior art, the stator 16 of the invention is upside-down mounted on the heat-dissipating plate 30. Since the airflow has to enter the frame from the inlet 14, the connection portions 23 has to be positioned away from the upper surface 12 and positioned close to heat-dissipating plate 30.

Although the temperature of the heat-dissipating plate 30 is relatively high, the electric elements 25 mounted on the printed circuit board 17 is relatively positioned away from the heat-dissipating plate 30 as possible as it can because the stator 16 is upside-down mounted in the frame 11. Therefore, the high temperature of the heat-dissipating plate 30 does not greatly influence the electric elements 25. As a result, the service life of the centrifugal fan 10 having an upside-down mounted structure can be prolonged.

Conversely, the printed circuit board of the prior art is relatively positioned close to the heat-dissipating plate with high temperature. Therefore, the electric elements mounted on the printed circuit board is apt to be damaged by the high temperature, thereby, the service life of the fan is shorten.

On the other hand, the centrifugal fan 10 of the present invention being able to provide a higher air pressure than that of the axial-flow fan can help to improve the heat dissipating effect of the fan.

Furthermore, since the upside-down mounted centrifugal fan 10 of the invention has its own flow duct 26, the forming of an extra flow duct on the heat-dissipating plate 30 is not needed. Therefore, the total weight of the heat-dissipating device can be reduced in order to meet the demand of low-weighted electrical products.

While the invention has been described by way of example and in terms of a preferred embodiment, it is to be understood that the invention is not limited to the disclosed embodiment. On the contrary, it is intended to cover various modifications. Therefore, the scope of the appended claims should be accorded the broadest interpretation so as to encompass all such modifications. For instance, the numbers of inlets 14 and ribs 19 are not limited to three. In addition, the centrifugal fan 10 having an upside-down mounted structure can operates normally with one or more inlets 14 and ribs 19.

What is claimed is:

1. A centrifugal fan having an upside-down mounted structure on a heat-dissipating plate comprising:

a frame fixed on said heat-dissipating plate, said frame including:

an upper surface positioned away from said heat-dissipating plate;

a side surface substantially perpendicular to said upper surface;

at least one inlet formed on said upper surface;

an outlet formed on said side surface; and an air duct defined therein;

a stator upside-down mounted in said frame and fixed on said upper surface, said stator including a printed circuit board positioned close to said upper surface and positioned away from said heat-dissipating plate; and a centrifugal impeller enclosing said stator and capable rotating with respect to said stator, wherein the air duct collects airflow generated by said centrifugal impeller to increase an air pressure and a quantity of air produced by the centrifugal fan.

2. The centrifugal fan having an upside-down mounted structure according to claim 1, wherein said frame further comprises:

a bearing seat connected to said upper surface of said frame; and at least one rib formed on said upper surface of said frame for fixing said bearing seat, said at least one inlet is defined by said upper surface of said frame and said at least one rib.

3. The centrifugal fan having an upside-down mounted structure according to claim 2, wherein said centrifugal impeller includes a hub and a plurality of blades respectively connected to said hub through a connection portion.

4. The centrifugal fan having an upside-down mounted structure according to claim 1, wherein said centrifugal impeller includes a hub and a plurality of blades respectively connected to said hub through a connection portion.

5. A centrifugal fan adapted to be used with a heat-dissipating plate comprising:

a frame fixed on the heat-dissipating plate, the frame having an air duct defined therein;

a stator upside-down mounted in the frame, wherein the stator includes a printed circuit board positioned away from the heat-dissipating plate; and a centrifugal impeller enclosing the stator and capable of rotating with respect to the stator, wherein the air duct collects airflow generated by said centrifugal impeller to increase an air pressure and a quantity of air produced by centrifugal fan.

6. The centrifugal fan according to claim 5, wherein the frame further comprises:

a bearing seat connected to the frame;

at least one rib formed on the frame for fixing the bearing seat; and at least one inlet formed on the frame and defined by the at least one rib.

7. The centrifugal fan according to claim 6, wherein the centrifugal impeller includes a hub and a plurality of blades respectively connected to the hub through a connection portion.

8. The centrifugal fan according to claim 5, wherein the centrifugal impeller includes a hub and a plurality of blades respectively connected to the hub through a connection portion.

* * * * *